United States Patent [19]

Katsumata et al.

[11] 4,170,206

[45] Oct. 9, 1979

[54] IGNITION SYSTEM FOR AN INTERNAL COMBUSTION ENGINE

[75] Inventors: Mitsuo Katsumata; Hirotoshi Nanjyo, both of Susono, Japan

[73] Assignee: Kokusan Denki Co., Ltd., Numazu, Japan

[21] Appl. No.: 782,385

[22] Filed: Mar. 23, 1977

[30] Foreign Application Priority Data

Aug. 27, 1976 [JP] Japan ..... 51-113934[U]

[51] Int. Cl.[2] ..... F02P 5/04

[52] U.S. Cl. ..... 123/148 CC; 310/153

[58] Field of Search ..... 123/148 E, 148 CC, 148 C; 310/70 R, 70 A, 74, 111, 153; 322/52

[56] References Cited

U.S. PATENT DOCUMENTS

| | | | |
|---|---|---|---|
| 3,139,876 | 7/1964 | Jukes | 123/148 E |
| 3,669,086 | 6/1972 | Beuk et al. | 123/148 CC |
| 3,736,914 | 6/1973 | Schmaldienst et al. | 123/148 CC |
| 3,741,186 | 6/1973 | Doi et al. | 123/148 CC |
| 3,861,372 | 1/1975 | Shibukawa et al. | 123/148 CC |
| 3,900,016 | 8/1975 | Haubner et al. | 123/148 CC |
| 3,961,618 | 6/1976 | Swift | 123/148 CC |
| 3,963,015 | 6/1976 | Haubner et al. | 123/148 E |
| 4,038,951 | 8/1977 | Schweikart | 123/148 CC |
| 4,074,669 | 2/1978 | Cavil et al. | 123/148 C |
| 4,079,712 | 3/1978 | Nagasawa | 123/148 CC |

*Primary Examiner*—Harold J. Tudor
*Assistant Examiner*—S. A. Cangialosi
*Attorney, Agent, or Firm*—Pearne, Gordon, Sessions, McCoy & Granger

[57] ABSTRACT

Disclosed herein is an ignition system for an internal combustion engine including a capacitor charged by charge power source, a thyristor for discharging the capacitor through the primary of an ignition coil and a magneto AC generator including a signal generating winding for supplying a gate signal to the thyristor. The ignition system is characterized in that rate of change of the magnetic flux interlinked with the signal generating winding has at least two successive local maximum points, so that at least two successive peaks of the same polarity appears in the voltage induced in the signal generating winding by the magnetic flux variation. The waveform of the voltage induced is utilized for ignition angle advance.

2 Claims, 8 Drawing Figures

IGNITION SYSTEM FOR AN INTERNAL COMBUSTION ENGINE

BACKGROUND OF THE INVENTION

The present invention relates to a breakerless ignition system of the capacitor discharge type for an internal combustion engine employing a thyristor for the discharge of the capacitor.

In a conventional ignition system of the kind, the triggering angle of the thyristor which is adapted to discharge the capacitor is determined by the output of the signal generating winding provided in a magneto generator rotating in synchronism with the engine. The range of ignition angle advance is limited to the mechanical angle approximately corresponding to a quarter cycle of the output of the magneto generator. As the number of the magnetic poles of the magneto generator is increased, the angle advance range becomes very narrow, with the result that satisfactory operation of the engine is not expected.

SUMMARY OF THE INVENTION

An object of the present invention is to provide an ignition system having a wide range of ignition angle advance.

Another object of the present invention is to provide an ignition system which enables the ignition angle to advance continuously with increasing engine speed.

Another object of the present invention is to provide an ignition system having a signal generating winding for supplying a gate signal to a thyristor incorporated in the ignition system once per one complete revolution of the engine.

Another object of the present invention is to provide an ignition system which does not require significant modification of a magneto AC generator which incorporate the signal generating winding as well as generating windings for energized head lights and for supplying ignition power, and does not increase the size of the generator.

An ignition system according to the present invention comprises an ignition coil, a capacitor, a charge power source for charging the capacitor, a thyristor for discharging the capacitor through the primary winding of the ignition coil, and a magneto AC generator having a signal generating winding for supplying a gate signal to the thyristor. The ignition system is characterized in that the magnetic pole structure of the generator is such as to cause at least two successive local maximum points to appear in the rate of change of the magnetic flux interlinked with the signal generating winding, so that the waveform of the voltage induced in the signal generating winding has at least two successive peaks of the same polarity. Such a structure will be exemplified in the following detailed description of the embodiments. The waveform of the voltage having successive peaks may be utilized to produce a current which first rises relatively rapidly until the voltage reaches the first peak, then slowly changes until the successive voltage rise occurs, and then rapidly rises again until the voltage reaches the second peak. This current variation thus has at least two successive rapidly rising portions and at least one slowly changing portion therebetween. The current may be transferred through the medium of a resistor having a relatively low resistance connected to permit the current flow therethrough to the gate of the thyristor. The second rapid portion is high enough to trigger the thyristor even when the engine and hence the generator are rotating at low speeds. The first rapid portion becomes high enough to trigger the thyristor when the engine speed becomes high. At the intermediate engine speeds, the triggering of the thyristor occurs during the period of the slowly changing portion of the current. Thus, a wide range of the ignition angle advance is achieved, and the angle varies continuously rather than discretely, from ignition angles for low engine speeds to ignition angles for high engine speeds.

BRIEF DESCRIPTION OF THE DRAWINGS

Other features and advantages of the present invention will be apparent from the following description taken in conjunction with the accompanying drawings, in which.

DETAILED DESCRIPTION OF THE PREFERRED EMBODIMENTS

Figure 1:
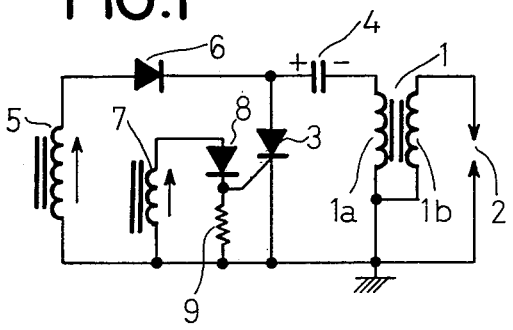
FIG. 1 is a circuit diagram of an embodiment of an ignition system according to the present invention.

Referring now more particularly to FIG. 1, there is shown an ignition system in accordance with the present invention. Denoted by numeral 1 is an ignition coil having a primary winding 1*a* and a secondary winding 1*b*. A spark plug 2 is connected across the secondary winding 1*b*. A capacitor 4 has one of its terminals connected to an end of the primary winding 1*a*. A generating winding 5 for charging the capacitor 4 is connected through a diode 6 across the series connection of the capacitor 4 and the primary winding 1*a*. A thyristor 3 for discharging the capacitor 4 through the primary winding 1*a* is connected across the series connection of the capacitor 4 and the primary winding 1*a*. A signal generating winding 7 for supplying a gate signal to the thyristor 3 is connected through a diode 8 across a resistor 9, the both ends of which are connected across the gate and cathode of the thyristor 3. The generating windings 5 and 7 are provided in a magneto AC generator rotating in synchronism with the internal combustion engine.

The capacitor 4 is charged into the polarity indicated by "+" and "−" in the drawing by the generating winding 5 when the latter produces an output of the polarity indicated by the arrow. As the output of the signal generating winding 7 becomes sufficient to trigger the thyristor 3, the thyristor 3 is turned on and therefore the capacitor 4 is discharged through the primary winding 1*a*, inducing a high voltage in the secondary winding 1*b* to effect firing of the spark plug 2 and hence ignition of the engine.

Figure 3:
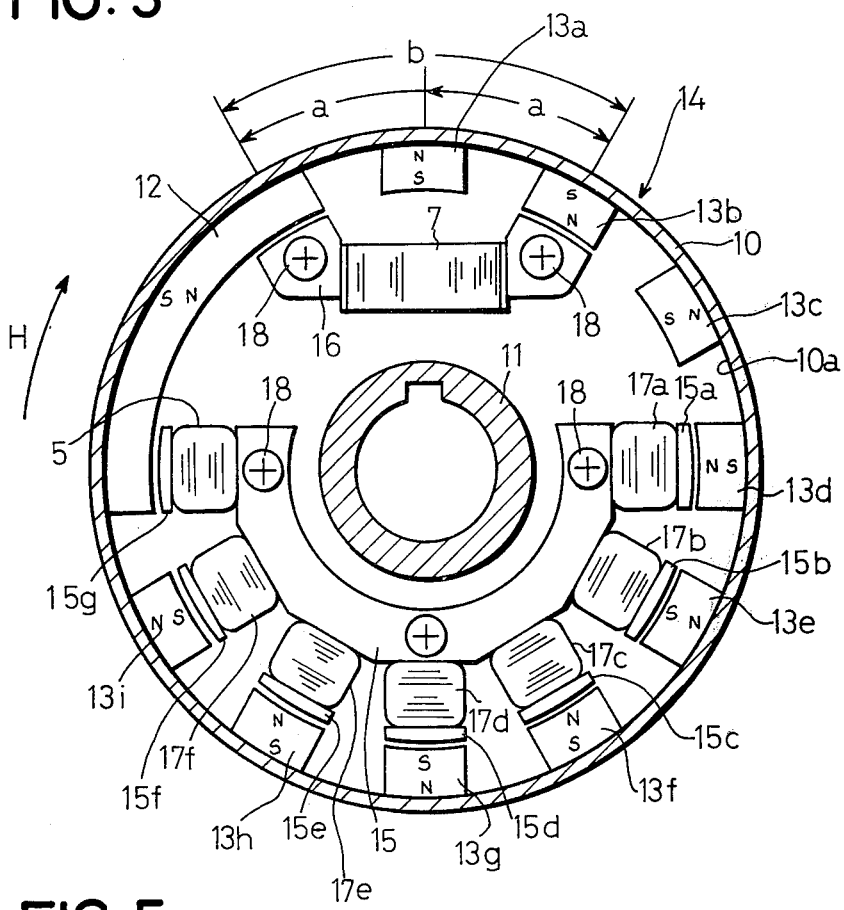
FIG. 3 is a sectional view of an embodiment of a magneto AC generator according to the present invention.

FIG. 3 illustrate in section an embodiment of a magneto AC generator. The rotor of the generator includes a substantially cup-shaped flywheel 10 of a magnetic material having a bottom wall provided with a boss 11, through which a shaft (normally a crank shaft of the engine) is inserted. The flywheel 10 also has a cylindrical wall, on the inner surface of which an elongated permanent magnet 12 and normal permanent magnets 13*a* through 13*i* are mounted. The permanent magnets 13*a* through 13*i* are positioned at the angular pole pitch of 30°, the pole pitch of ordinary 12-pole generator and are so magnetized that N and S poles appear alternately. In the embodiment illustrated, the magnets 13*a* and 13*i* are so magnetized that S pole appears on the inner surface. The elongated permanent magnets 12 has a length along the circumference corresponding to the length of three of the normal magnets joined together, and is so magnetized that N pole appears on the inner surface. The rotor 14 thus have a first magnetic region of a substantially uniform magnetic field due to the permanent magnet 12 placed therein and a second magnetic region of alternating magnetic field due to the permanent magnets 13*a* through 13*i* placed therein. The stator cooperating with the rotor 14 comprises a first stator core 15 of a substantially star shape having the pole pitch a corresponding to the pole pitch of the magnets 13*a* through 13*i*, and a second stator core 16 of a substantially U-shape having pole to pole distance b corresponding to distance between the center of the elongated magnet 12 and the center of the adjacent one of the normal magnets. The cores 15 and 16 are fixed by screws 18 to the stationary base not shown. In the embodiment illustrated, the first stator core 15 has seven salient portions 15*a* through 15*g*. The salient portions 15*a* through 15*f* have generating windings 17*a* through 17*f* wrapped thereon and used to energize various loads such as head lights. The salient portion 15*g* has the generating winding 5 wrapped thereon and used for charging the capacitor 4. The signal generating winding 7 is wrapped on the second stator core 16.

Figure 4A:
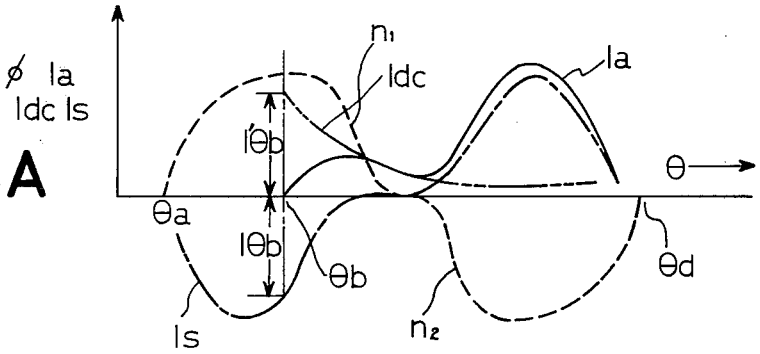
FIGS. 4A through 4D show waveforms of the voltage, current and magnetic flux at various portions of the ignition system of FIGS. 1 and 3.
Figure 4B:
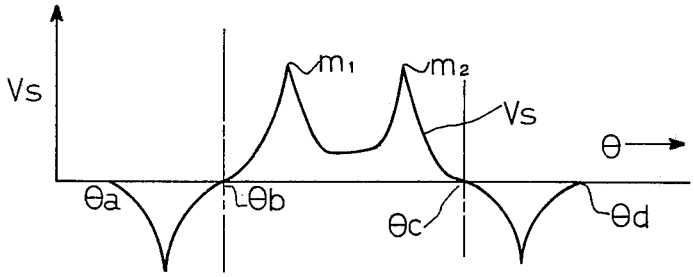
Figure 4C:
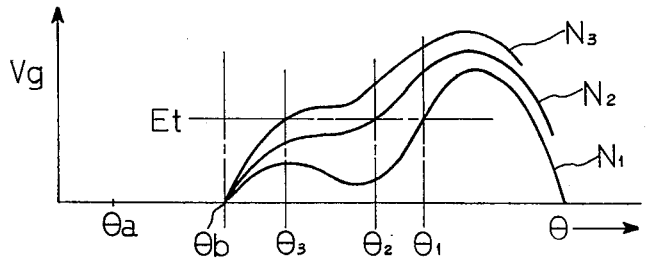

FIGS. 4A through 4C shows the waveforms of the voltage, current and magnetic flux of various portions of the ignition system of FIGS. 1 and 3. As the rotor 14 rotates once in the direction of the arrow H shown in FIG. 3, the magnet 12 and the magnet 13*b* are magnetically coupled to each other through the core 15 at an angle $\theta$a and the magnet 12 and the magnet 13*h* are coupled to each other at an angle $\theta$d. Between the angles $\theta$a and $\theta$d, the magnetic flux $\phi$ interlinked with the signal generating winding 7 varies as illustrated by the dotted lines in FIGS. 4A and 4B.

The waveform of the magnetic flux $\phi$ has two successive points n1 and n2 where the rate of change of the magnetic flux $\phi$ is the maximum. The result is that the waveform of the voltage Vs induced has two successive peaks m1 and m2 of the same polarity. The current Ia caused by the voltage Vs to flow through the diode 8 and the resistor 9 is determined from the following analysis. Since the diode 8 permit unidirectional current only, the current begins to flow at an angle $\theta$b at which the voltage Vs becomes positive with respect to the diode 8, so that normal procedure for analyzing transient phenomenum may be utilized. Supposing that the output terminals of the generator are shorted at the angle $\theta$b the resultant current Ia is the sum of the stationary current Is shown by the chain line which would continue to flow if the generator had been shorted and the transient current Idc shown by the dotted lines which would begin to flow if a DC power supply were inserted at the angle $\theta$b to cause an attenuation current with initial value equal in magnitude and opposite in polarity to the instantaneous value of the stationary current Is at the angle $\theta$b. The waveform of the current Ia thus becomes as shown by a solid line.

Figure 4D:
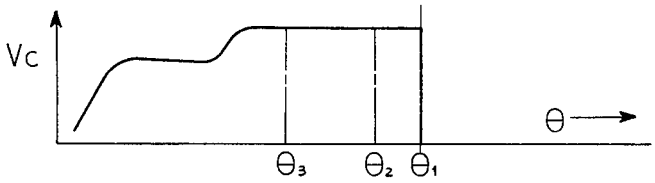

The waveform of the current flowing through the diode 8 and the resistor 9 owing to the positive voltage Vs induced during the angles from $\theta$b to $\theta$d resembles the waveform of the current Ia. The voltage Vs and therefore the current Ia are dependent on the rotational speed of the engine crank shaft. The voltage drop Vg across the resistor 9 is proportional to the current Ia flowing therethrough. The voltage drop Vg therefore varies as shown in FIG. 4C as the engine speed is at N1, N2 and N3 (N1<N2<N3), respectively. The voltage Vg of the waveform as shown in FIG. 4C is imposed on the gate of the thyristor 3. As the imposed voltage Vg reaches the gate trigger level Et of the thyristor 3, the thyristor 3 is made conductive, which in turn leads to discharge of the capacitor 4. The capacitor has been charged by the charge winding 5 as shown in FIG. 4D.

Figure 2:
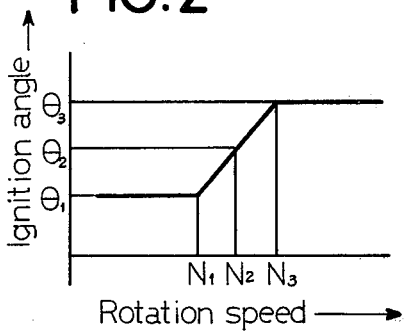
FIG. 2 shows the characteristics of ignition angle relative to the engine speed in accordance with the present invention.

At a relatively low engine speed N1, the voltage drop Vg reaches the gate trigger level Et at an angle $\theta$1, where the second peak of the voltage Vs causes a high rise of the current Ia and hence the voltage drop Vg. As the engine speed is increased the voltage drop Vg is also increased. In addition, although the waveform of the voltage drop Vg at the speed N1 has a valley between the peaks, this valley diminishes with the increase of the engine speed. Consequently, the voltage drop Vg reaches the gate trigger level Et at an angle $\theta$2, in advance of the angle $\theta$1. As the engine speed is further increased to N3, the voltage drop Vg is further increased and the instantaneous value of it reaches the gate trigger level Et at an angle $\theta$3 in advance of the angle $\theta$2. This is where the first peak of the voltage induced causes a initial rise of the current. Consequently, the conduction of the thyristor 3, the discharge of the capacitor 4 and the resultant firing of the spark plug 2 occurs at angles $\theta$1, $\theta$2 and $\theta$3 as the engine speed is at N1, N2 and N3, respectively. As schematically shown in FIG. 2, the ignition angle advances from $\theta$1 to $\theta$3 as the engine speed is increased from N1 to N3. The mechanical angle which is proportional to the length of the waveform of the voltage drop Vg is about twice that of the waveform of a voltage which would be obtained if a conventional rotor having equally spaced magnets through the periphery were employed in cooperation with a U-shaped stator core having a pole to pole distance equal to that of the pole pitch of the rotor. Accordingly, sufficient angle advance is obtained. Also, since the valley of the waveform of the voltage drop Vg between the peaks diminishes with increasing engine speed, the angle advances continuously rather than in a stepping fashion between discrete angles.

Figure 5:
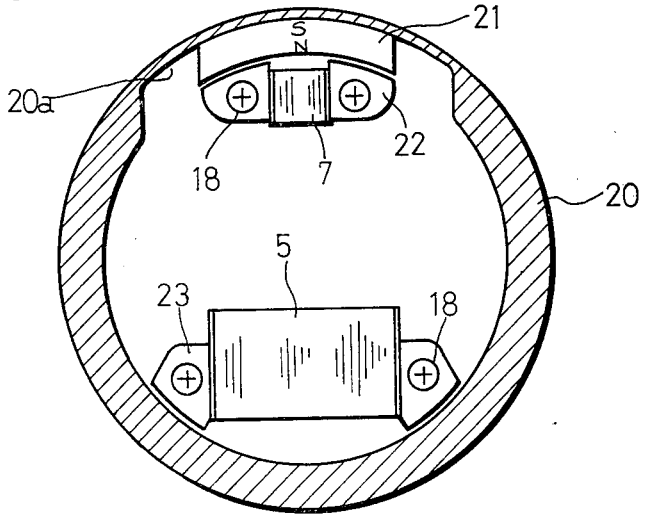
FIG. 5 is a sectional view of a modification of a magneto generator in accordance with the present invention.

In the embodiment described above, the rotor has at a part thereof a magnetic region through which alternation of the polarity does not occur. The scope of the present invention is however not limited to the above embodiment, but covers various modifications of the magneto AC generator having various magnetic pole structure which is capable of producing at least two successive local maximum points in the rate of change of the magnetic flux interlinked with the signal generating winding. For instance, as shown in FIG. 5, one may use a substantially cup-shaped flywheel 20 having a relatively thick cylindrical wall with an indented portion 20*a* provided on the inner periphery of the flywheel and a permanent magnet 21 placed in the indented portion 20*a* and magnetized in the radial direction. The core may be of a substantially U-shape with one of its pole confronting the thick wall portion of the rotor while the other pole confronting the permanent magnet 21, and a pole to pole distance being shorter than the circumferential length of the indented portion 20*a*. In the embodiment shown in FIG. 5, the U-shaped core has a pole to pole distance approximately equal to the circumferential length of the permanent magnets 21. The generating winding 5 for charging the capacitor 4 is wrapped on a substantially U-shaped core 23 distanced 180° from the core of the signal generating winding 7.

It is noted that in the ignition circuit in FIG. 1, the positioning of the capacitor 4 and the thyristor 3 may be altered. Also, between the signal generating winding 7 and the thyristor 3 may be inserted a signal convertor circuit which, in response to the output of the signal generating winding exceeding a predetermined value, produces a pulsative signal. Moreover, batteries may be employed in place of the generating winding 5 for charging the capacitor.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. An ignition system for an internal combustion engine comprising an ignition coil having a primary winding and a secondary winding, a capacitor, a charge power source for supplying charge current of said capacitor, a thyristor for discharging said capacitor through said primary winding, and a magneto AC generator having a signal generating winding connected through a diode across the gate and cathode of said thyristor, characterized in that said generator has a rotor including a substantially cup-shaped flywheel with a plurality of permanent magnets arranged about the inner periphery of said flywheel so as to produce a substantially alternating magnetic field about the circumference except at a part thereof where the magnetic field is unchanged, and a substantially U-shaped stator core on which said signal generating winding is wrapped, said U-shaped stator core having a pole to pole distance corresponding to the circumferential length of said part where the magnetic field in unchanged, whereby at least two successive local maximum points to appear in the rate of change of the magnetic flux interlinked with said signal generating winding, so that the waveform of the voltage induced in said signal generating winding has at least two successive peaks of the same polarity.

2. An ignition system for an internal combustion engine comprising an ignition coil having a primary winding and a secondary winding, a capacitor, a charge power source for supplying charge current of said capacitor, a thyristor for discharging said capacitor through said primary winding, a magneto AC generator having a signal generating winding connected through a diode across the gate and cathode of said thyristor, characterized in that said generator has a rotor including a substantially cup-shaped flywheel having thick cylindrical wall with an indented portion on the inner periphery thereof, and a permanent magnet placed in said indented portion, said signal generating winding being wrapped on a substantially U-shaped core with the pole to pole distance thereof being shorter than the circumferential length of said indented portion, whereby at least two successive local maximum points are caused to appear in the rate of change of the magnetic flux interlinked with said signal generating winding, so that the waveform of the voltage induced in said signal generating winding has at least two successive peaks of the same polarity.

* * * * *